United States Patent [19]

Cathiard

[11] Patent Number: 4,833,997

[45] Date of Patent: May 30, 1989

[54] BICABLE AERIAL TRANSPORT SYSTEM OPERATING ON TWO CARRIER AND HAULAGE ROPES RUNNING ON OFF-SET PULLEYS

[75] Inventor: Jean-Pierre Cathiard, Noyarey, France

[73] Assignee: Pomagalski SA, France

[21] Appl. No.: 103,893

[22] Filed: Oct. 1, 1987

[30] Foreign Application Priority Data

Oct. 2, 1986 [FR] France ..... 86 13902

[51] Int. Cl.[4] ..... B61B 9/00

[52] U.S. Cl. ..... 104/28; 104/180; 104/192

[58] Field of Search ..... 104/27, 28, 89, 91, 104/96, 173.1, 173.2, 180, 189, 191, 192

[56] References Cited

U.S. PATENT DOCUMENTS 4,509,430 4/1985 Creissels ..... 104/180 X

FOREIGN PATENT DOCUMENTS 108924 2/1928 Austria ..... 104/173.1
376405 10/1921 Fed. Rep. of Germany ..... 104/180
1249949 11/1960 France ..... 104/173.1
194927 3/1938 Switzerland ..... 104/173.1

*Primary Examiner*—Johnny D. Cherry
*Assistant Examiner*—Frank H. Williams
*Attorney, Agent, or Firm*—Fred A. Keire

[57] ABSTRACT

A bicable ropeway aerial transport system is disclosed which includes a pair of carrier and haulage ropes and at least two pair of end pulleys that are respectively engaged with the ropes in embarking and disembarking stations. The end pulleys in at least one of the stations are offset longitudinally and form between them a free space dimensioned to permit the engagement and disengagement of the vehicles from between the ropes in the free space.

34 Claims, 3 Drawing Sheets

FIG.4
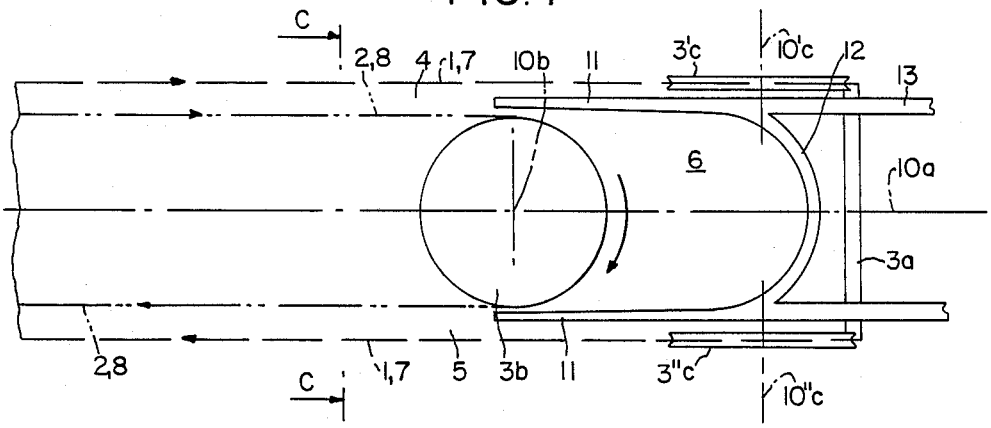
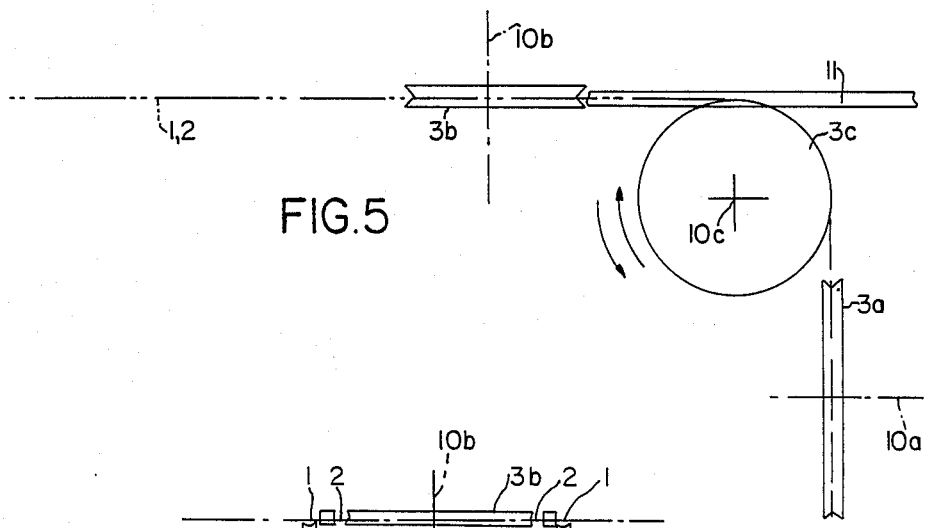
FIG.5
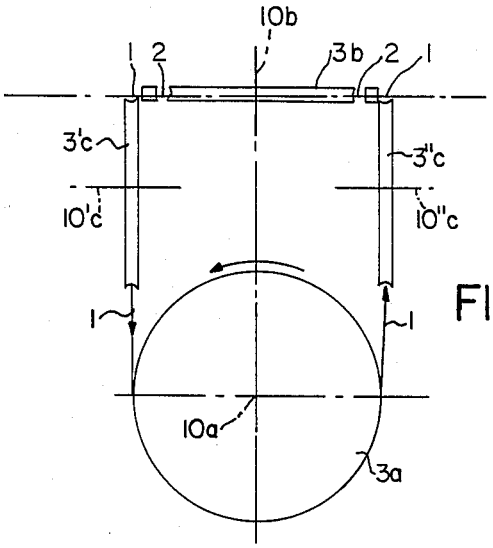
FIG.6

BICABLE AERIAL TRANSPORT SYSTEM OPERATING ON TWO CARRIER AND HAULAGE ROPES RUNNING ON OFF-SET PULLEYS

The invention relates to a bicable ropeway aerial transport system operating on two carrier and haulage ropes running on off-set pulleys.

A transport system operating on aerial ropeways is known per se to the man of the Art. Therefore, the following description refers expressly only to members and component elements playing a specific role. On the other hand, the other members or components elements (notably the vehicles) are not described, since they are implicitly known.

Aerial ropeway transport systems are already known which comprise one or a plurality of vehicles, each vehicle being rigidly yet releasably connected to a pair of endless, respectively carrying and haulage ropes parallel to each other, disposed side by side in the horizontal direction, driven for travelling linearly and supported by intermediate towers. Between two embarking/disembarking terminal stations, the ropes constitute two tracks along which the vehicles are moved. In these embarking/disembarking stations, travellers or goods are embarked/disembarked to an from the vehicles.

Such systems using twin carrying and haulage ropes (each rope acting both a carrying rope and as a haulage rope) possess many advantageous features, notably the possibility of operating at high speeds and an increased loading capacity (hence a greater passengers or goods output) and a better lateral stability of the vehicles (resistance to wind pressure). The fact that the vehicles are releasably connected to the ropes permits not only of disengaging the vehicles from the ropes in the embarking/disembarking terminal stations, with a view to reduce the vehicle speed without changing the rope speed, but also of storing the vehicles at the station. One can also easily adapt the number of vehicles in service to specific traffic requirements.

The problems arising in such known systems result from the presence of two ropes in conjunction with the fact that it is desired to have the possibility of coupling-/uncoupling the vehicles carried by the ropes.

The French Patent No. 1,249,949 discloses a system in which the vehicles are associated with the ropes by means of grips engaging the ropes from beneath. The uncoupling will thus take place naturally by opening the grips, and the vehicles are moved away from the ropes simply by descending therefrom. This system is a fictitious one, for the reliability of the coupling between the vehicles and the ropes is unwarranted, since the weight tends to open the grips and thus cause an untimely uncoupling.

The French Patent No. 2,525,981 and European Patent No. 093,680 disclose a system in which the grips are in a conventional, safer way caused to engage the ropes from above. To prevent the vehicle from remaining trapped between the ropes after opening the grips, roller means are provided for guiding the horizontal ropes or ropes having inclined axes, thus changing the distance between the ropes to permit the disengagement of the vehicle and the movement thereof on transfer rails independent of the ropes. This solution is also unsatisfactory. In fact, the carrying and haulage ropes have a relatively great diameter and are strongly tensioned. Therefore, installing rope diverting rollers with horizontal or inclined axes for changing the distance between the two ropes is not only extremely delicate from a technical point of view, but also a source of safety problems, since the ropes are then subjected to unadequately controlled torsion stresses and liable inasmuch to escape from the rollers. This possibility must in any case be avioded in the embarking/disembarking stations. Moreover, the risks of derailment are proportional to the number of diverting rollers used in the system.

This invention is directed to avoid these inconveniences and has for its object an aerial transport system wherein the distance between the ropes, or gage, remains constant along the route and relatively moderate (that is, inferior to the transverse dimension of the vehicles, conventionally of 0.5 m to 3 m, notably 0.75 m and 1.4 m); the grips are caused to bear on the top surface of the ropes; the vehicles may be simply engaged/disengaged between or from between the ropes in the terminal stations without inasmuch jeopardizing the reliability of the system (the risks of derailment are minimized), nor increasing costs.

For this purpose, the invention provides an aerial transport system with two carrying and haulage ropes, this system comprising firstly two substantially parallel carrying and haulage ropes driven continuously and forming an endless loop passing around driving and/or return-tensioning end pulleys disposed at the embarking and disembarking stations; secondly, at least one and generally a plurality of vehicles provided with releasable rope-clamping grippers, and thirdly, means for releasing and re-engaging the grippers and means for supporting/guiding the vehicles at the embarking-/disembarking stations, so that along the route the vehicles can be engaged between, driven and carried by, the ropes, and that in the embarking/disembarking stations the vehicles can be totally disengaged and disconnected from the ropes, this system being characterised by the fact that at least two longitudinally off-set end pulleys cooperating with each rope respectively in at least one embarking/disembarking terminal station provide between said ropes a free space of such dimension that it permits the engagement/disengagement of the vehicle between or from between the ropes in said free space. The invention is more particularly advantageous when, in combination, the grips, in the engaged condition, bear on the top surface of the rope, and also in case each vehicle is slung from a carrier for example of the type comprising two pairs of clamping grips.

In a system according to the invention, the distance between the two ropes is kept constant up- and downstream of the end pulleys, and no rope diverting roller, as used heretofore for changing the relative distance of the two ropes, is provided on the inlet or outlet side, or between the end pulleys.

Moreover, according to the invention, the length of the free space is greater than that of a carrier or vehicle; the ropes do not cross each other; and the pulleys may be coplanar, two in number (one per rope) and aligned longitudinally but with different diameters and rotational speeds. Alternatively, a pulley may be provided in the plane formed by the two ropes, another pulley being substantially perpendicular or inclined; one rope engages one and single pulley, or a plurality of pulleys.

A system according to the invention is therefore highly reliable and strong, even when high rope tensions are used, since the system is free of diverting rollers, notably rollers having horizontal or inclined axes, for modifying the distance between ropes. The safety of the transport system is thus greatly improved in comparison with the present state of the art. On the other hand, the engagement/disengagement of the vehicles from between and between the ropes, respectively, takes place in the free space in a simple, safe way. The distance between ropes is constant along the traffic routes, and normally reduced (less than the width of the vehicles). No particular device is required on the vehicles or carriers, or in the stations, for disengaging/engaging the vehicles or carriers from between or between the ropes. Another advantage is the possibility of adapting the upward or downward disengagement and engagement movements as a function of possible local conditions (ground gradients, upper or lower station, or else).

Other features and advantages of the invention will appear as the following description proceeds with reference to the attached drawings, in which:

FIG. 4 is a diagrammatic plane view illustrating the paths followed by ropes in an embarking/disembarking station according to a second form of embodiment of the invention.

FIG. 5 is an elevational view of FIG. 4.

FIG. 6 is a section taken along the line C—C of FIG. 4, and

Figure 1:
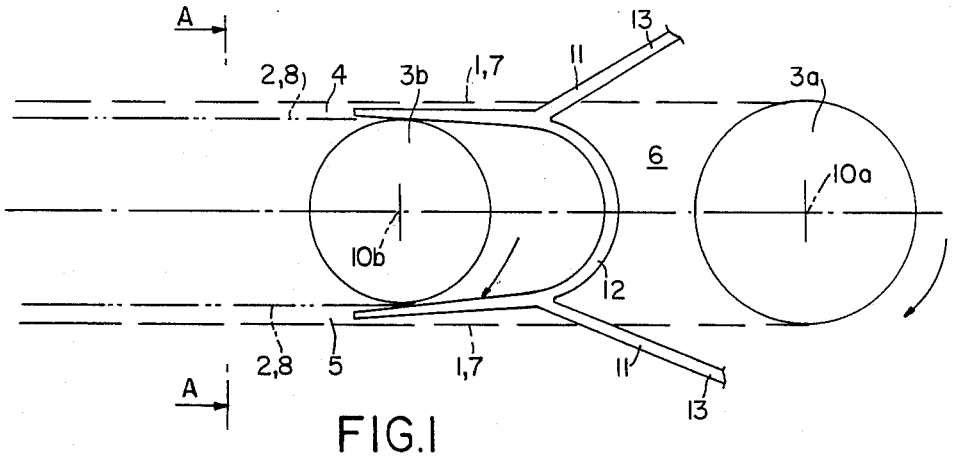
FIG. 1 is a diagrammatic plane view illustrating the paths followed by the ropes in an embarking/disembarking station according to a first form of embodiment of the invention.

The invention relates to an aerial transport system using two substantially parallel carrying and haulage moving ropes 1, 2, respectively, driven continuously in the same direction and forming two endless loops passing around end pulleys 3 located at embarking/disembarking terminal stations. In at least one of the embarking/disembarking stations, the pulleys 3 are adapted to drive the ropes 1, 2. In at least one of the embarking-/disembarking stations, the pulleys 3 acts as return/tensioning pulleys to the ropes 1, 2. In the following disclosure, the terms "end pulley 3" designates any pulley 3 for driving and/or return tensioning a rope 1, 2 constituting the end section of a loop formed by said ropes 1, 2. The ropes 1, 2 define two traffic routes which, in each embarking/disembarking station, may be referred to as an incoming route 4 and an outgoing route 5 with respect to the direction of travel of ropes 1, 2.

Secondly, the system comprises at least one and as a rule a plurality of vehicles provided with releasable grips for gripping the ropes 1, 2. Generally, each vehicle is supported by a carrier provided with releasable grips, for example through the medium of hinged suspension means.

Thirdly, the system comprises means for disengaging and engaging the grips, and the means 11, 12, 13 for supporting/guiding the vehicles and/or trucks at the embarking and disembarking stations, so that in operation the vehicles are engaged between, driven by, and suspended from, the ropes 1, 2, and that in the embarking/disembarking stations the vehicles are completely disengaged and uncoupled from ropes 1, 2.

The two ropes 1, 2 constituting each traffic route 4, 5 are at least substantially parallel and form together, at least locally (between two intermediate towers and at the terminal stations) a common travel plane P. This plane P is referred to herein as the "rope plane". The term "horizontal" direction designates any direction contained in this plane P, through in actual service the plane P of ropes 1, 2 may be inclined when the ropes travel to or from an upper station and a lower station. The term "vertical direction" refers to a direction perpendicular to the plane P of ropes 1, 2. Likewise, the terms "longitudinal" and "lateral" directions refer to the horizontal directions parallel to ropes 1, 2, respectively to the direction horizontal and perpendicular to ropes 1, 2.

The terms "downstream" and "upstream" are used in the following disclosure with reference to the direction of travel of the moving ropes 1, 2. The terms "inner rope" and "outer rope" denote in the following description the ropes extending inside and outside, respectively, the loop formed by the traffic routes of the vehicles, that is, by the two loops formed by ropes 1 and 2.

In the following disclosure, the invention is described with reference to a same and single embarking/disembarking station. It is understood that the features characterizing the invention may advantageously be reproduced or repeated in several or all the embarking-/disembarking stations of the system.

According to the invention, at least two end pulleys 3 engaged by each rope 1, 2 in at least one embarking-/disembarking station are off-set longitudinally and provide between them a free space 6 of such dimensions as to permit the engagement/disengagement of the vehicle, notably of the carrier, between or from between the ropes 1, 2 in said free space 6. Thus, at least one 3*a* of said pulleys 3 cooperating with a rope 1 is longitudinally outermost with respect to another 3*b* of said pulleys 3 cooperating with the other rope 2.

According to the invention, in the engaged condition, the grips rest on the upper surface of ropes 1, 2. The invention is also applicable in the opposite case wherein the grips engage the rope from beneath or from the inner or outer sides, but this arrangement is definitely less advantageous since the problem of engaging/disengaging the vehicles between or from between the ropes 1, 2 is not so important.

Similarly, the invention is advantageous when a carrier comprises two grips, that is, four grips associated by pairs with each rope 1, 2. The four grips form as a rule a rigid quadrilateral.

According to an essential feature of the invention, the distance or gage between the two ropes 1, 2 is kept constant both upstream and downstream of the end pulleys 3. This gage between ropes 1, 2 may have a conventional value. For instance, this gage is smaller than the lateral overall dimension of the vehicle. However, the invention is also applicable to the opposite case wherein the distance or gage between ropes 1, 2 is greater than the overall lateral dimension of the vehicle but with less interest since the disengagement/engagement can take place in a different manner. This distance ranges for example from 0.5 m to 3 m, and is notably of the order of 0.75 m, or of the order of 1.4 m. Therefore, a system according to the invention is free of diverting rollers—notably rollers having inclined axes—for guiding the ropes 1, 2 with a view to change their gage upstream and downstream of end pulleys 3. It is also preferably free of rollers for diverting the ropes 1, 2 between the end pulleys.

To permit the passage of the carrier and the engagement/disengagement of the vehicle between and from between the ropes 1, 2, the length of the free space 6 between two end pulleys 3*a*, 3*b* off-set longitudinally with respect to an embarking/disembarking station is definitely greater than the length, that is, the longitudinal overall dimension of a carrier.

According to the invention, at least one rope 1 and/or 2 co-operates with one and single end pulley 3. In the first form of embodiment illustrated (FIGS. 1–3) both ropes 1, 2 cooperate each with one and single end pulley 3, and the embarking/disembarking station comprises two longitudinally off-set end pulleys 3, one per rope 1, 2. Alternatively, (FIGS. 4–6 and FIG. 7) at least one rope 1, 7, co-operates with at least two, more particularly at least three end pulleys 3.

In at least one embarking/disembarking station the end pulleys 3*a*, 3*b* are so arranged that the outer rope 1, 7 (or the inner rope 2, 8) of the incoming route or track 4 also comprises the rope 1, 7 (or the inner rope 2, 8) of the outgoing track 5, the relative positions of ropes 1, 2 (i.e. with respect to each other) between the two incoming and outgoing tracks 4, 5 remaining unchanged.

In a system according to the invention the ropes 1, 2 do not cross each other between the end pulleys 3. For instance, the two loops formed by said ropes 1, 2 are imbricated in each other. Thus, the loop formed by the inner rope 2, 8 is enclosed completely in the loop formed by the outer rope 1, 7. It is thus clear that the ropes 1, 2 of a system according to the invention cannot cross each other in the stations or between the stations, for obvious reasons, the inner rope 2, 8 in one station remaining the inner rope 2, 8 in the other stations and being shorter than the other or outer rope 1, 7, and that said ropes 1, 2 have different lengths. The outer rope 1, 7 of incoming track 4 co-operates with the longitudinally endmost pulley 3*a*, the inner rope 2, 8 of the incoming track 4 co-operating with the longitudinally less endmost pulley 3*b*. The pulleys 3 have different diameters and are driven at different rotational speeds so that the ropes 1, 2 move in synchronism with each other.

Preferably, the end pulleys 3 of at least one station have parallel axes of rotation 10. Alternatively, or in combination, at least two axes 10 may be inclined with respect to each other, notably assume a orthogonal position to each other. Advantageously, at least two axes 10 are coplanar. It will thus be seen (FIGS. 1–6) that the two axes 10*a*, 10*b* of pulleys 3*a*, 3*b* are coplanar and the plane containing these axes 10*a*, 10*b* also contains the longitudinal direction of ropes 1 and 2.

Moreover and preferably, at least one of the end pulleys 3 of an embarking/disembarking station lies in the plane P of ropes 1, 2 of the outgoing and/or incoming tracks 5, 4 respectively (the plane P of ropes 1, 2 of the outgoing track 5 is generally the same as that of the incoming track 4, but this is not a strict requirement).

When the axes 10 of pulleys 3 are parallel, the pulleys 3 are also parallel and preferably co-planar. Also preferably, the axis 10 of at least one end pulley 3 is perpendicular to the plane P of ropes 1, 2. In certain cases the axis 10 of at least one end pulley 3 is parallel to the plane P of ropes 1, 2.

In a specific form of embodiment of the invention, at least one of the end pulleys of at least one station is off-set so as to be perpendicular to the plane P of ropes 1, 2. For example, the longitudinally less endmost pulley 3*a* is off-set upwards and/or the longitudinally less endmost pulley 3*b* is off-set downwards with respect to the plane P of ropes 1, 2. The other case is possible wherein the longitudinally endmost pulley 3*a* is off-set downwards and/or the longitudinally less endmost pulley 3*b* is off-set upwards with respect to the plane P of ropes 1, 2. Therefore, all the cases can be contemplated (the two pulleys upwards, the two pulleys downwards, one pulley upwards and the other pulley downwards).

Thus, an arrangement according to the invention comprises, in at least one embarking/disembarking station, intermediate pulleys (3*c*) disposed upstream and downstream of at least one end pulley (3*a*, 3*b*) off-set perpendicularly to the plane P of ropes 1, 2, so that at least one rope (1 or 2) is returned to the end pulley (or pulleys) (3*a*, 3*b*) corresponding to said rope 1 or 2.

Figure 2:
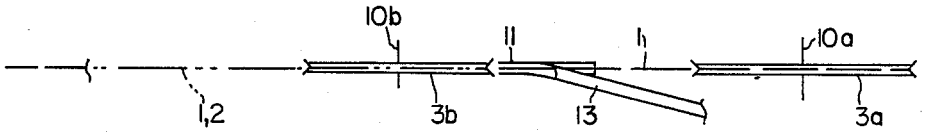
FIG. 2 is an elevational view of FIG. 1.
Figure 3:
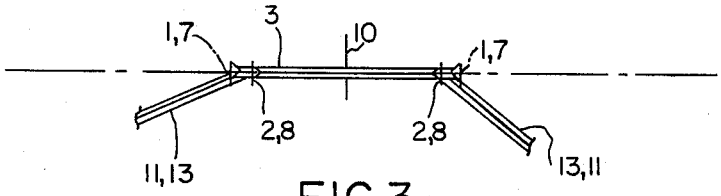
FIG. 3 is a section taken along the line A—A of FIG. 1.
Figure 7:
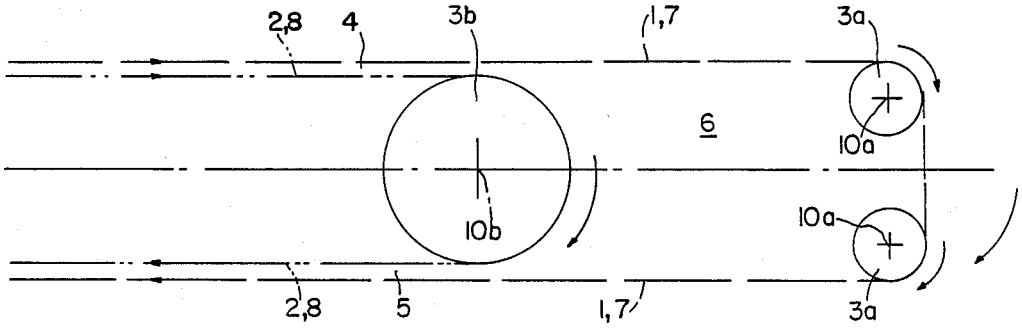
FIG. 7 is a diagrammatic plane view illustrating the paths followed by the ropes in an embarkment/disembarkment station according to a third form of embodiment of the invention.

In a first form of embodiment shown in FIGS. 1–3, an embarking/disembarking station comprises two coplanar end pulleys 3*a*, 3*b* located in the plane P of the ropes 1, 2 of outgoing track 5 and/or incoming track 4 having parallel axes 10*a*, 10*b* aligned in the longitudinal direction. The endmost pulley 3*a* co-operating with the outer ropes 1, 7 has a greater diameter and rotates at a lower speed than the less endmost pulley 3*b* cooperating with the inner rope 2, 8.

In a second form of embodiment illustrated in FIGS. 4–6, an embarking/disembarking station comprises on the one hand a less endmost pulley 3*b* co-operating with the inner rope 2, 8 of which the axis 10*b* is perpendicular to the plane P of ropes 1, 2, said pulleys 3*b* lying in said plane P, and on the other hand three pulleys 3*a*, 3′*c*, 3″*c* co-operating with the outer rope 1, 7. One endmost pulley 3*a* co-operating with the outer rope 1, 7 is substantially vertical and off-set downwards (or upwards) with respect to the plane P, the axis 10*a* of this pulley being parallel to the plane P disposed in the longitudinal direction. Two other intermediate pulleys 3′*c*, 3″*c* more endmost than pulley 3*b* are provided for guiding the rope 1 towards the endmost pulley 3*a*. These intermediate pulleys 3*c* are substantially vertical and have their axes 10*c* disposed in the plane P of ropes 1, 2 disposed in the lateral direction. One of said pulleys 3′*c* is disposed upstream of the endmost pulley 3*a*, and the other pulley 3″*c* is disposed downstream thereof. The corresponding axes 10′*c*, 10″*c* are aligned. The pulleys 3′*c*, 3″*c* rotate in opposite directions and the distance between them corresponds to the diameter of the endmost pulley 3*a* which has a greater diameter and rotates at a lower speed than the less endmost pulley 3*b* co-operating with the inner rope 1, 8. The fact that the endmost pulley 3*a* is off-set vertically—notably perpendicularly—with respect to the less endmost pulley 3*b* permits the engagement/disengagement of the vehicles between/from between the ropes 1, 2 along a straight line in the longitudinal prolongation of ropes 1, 2. The diameter of the endmost pulley may differ from the distance between the intermediate pulleys 3*c* which should then by inclined to the vertical towards said endmost pulley 3*a*.

In a third form of embodiment (FIG. 7), a rope 1, 2 co-operates with at least two sequent end pulleys 3 assuming respectively one fraction of the load applied to or exerted by the rope 1, 2. For example, two laterally spaced endmost pulleys 3*a* are provided, the centres of said pulleys 3*a* being aligned in the lateral direction, their axes 10*a* being parallel. The loop thus formed is more out-flared. Moreover, the diameter of each pulley 3 may be reduced with respect to the structure comprising only one pulley 3. This arrangement, advantageous for the outer rope 1, 7, may also be contemplated for the inner rope 2, 8 and in combination with anyone of the above-described forms of embodiment (FIGS. 1–3 or FIGS. 4–6).

The support/guide means (not shown in FIG. 7) consist of transfer rails 11 engageable by the wheels of the carrier and/or vehicle.

The transfer rails 11 extend at least transversely across the less endmost pulley 3*b* to permit the coupling and uncoupling of the vehicles with respect to the ropes 1, 2 downstream and upstream of end pulleys 3: The uncoupling operation comprises a step consisting in releasing the grips of the corresponding ropes 1, 2 by opening the grip jaws, and a subsequent step consisting in diverting the carrier supporting the grips upwards with respect to the ropes 1, 2. Thus, the transfer rails 11 follow, across the less endmost pulley 3*b* in the incoming track 4, an ascending path with respect to the plane of ropes 1, 2, to avoid any interference between the carrier and the pulleys 3.

Likewise, the coupling phase comprises a engagement step and also a step consisting in moving the carrier downwards with respect to ropes 1, 2, the transfer rails 11 of outgoing track 5 being diverted downwards with respect to the plane P of ropes 1, 2.

In an arrangement according to the invention and in certain forms of embodiment thereof, the transfer rails 11 may be caused to intersect the vertical longitudinal plane containing the rope 1 co-operating with the longitudinally endmost pulley 3*a* by passing beneath or above, but without intersecting, the path of rope 2 co-operating with the longitudinally less endmost pulley 3*b*, that is, by passing neither beneath, nor above it.

In the first form of embodiment (FIGS. 1–3) the transfer rails 11 are interconnected by a semi-circular section 12 enabling a vehicle to be transferred directly from the incoming track 4 to the outgoing track 5 while embarking/disembarking (or loading/unloading) travellers or goods. In a modified version or in combination with this first form of embodiment, the transfer rails 11 comprise outgoing transfer sections 13 leading to sidings or shunts, or to other track sections. In this specific form of embodiment the transfer sections 13 should intersect the vertical plane of the external rope 1, 7 engaging the endmost pulley 3*a* by passing beneath or above the external rope 1, 7 upstream, downstream or across this pulley 3*a*. In the case of the above-defined passage, the height between the track 13 and rope 2 should be sufficient to permit the passage of the vehicle slung from the track 13 above the external rope 1, 7.

In the second form of embodiment (FIGS. 4–6) the transfer rails 11 remain substantially horizontal and longitudinal and pass between the two intermediate pulleys 3*c*. The transfer rails 11 of the incoming track 4 and those of the outgoing track 5 may be connected to provide a half-turn, semi-circular or return section 12, and/or have an extension 13 leading to sidings or other track sections. The half-turn section 12 may be so disposed as to enable the carriers to turn back either in the free space 6 left between the pulleys 3, or externally. The endmost pulley 3*a* is disposed at a level low enough to permit the passage of the vehicles rolling on transfer rails 11 above said pulley 3*a*. The transfer rails 11 do not intersect the vertical longitudinal plane containing the rope 1 co-operating with the endmost upstream or downstream portion 3*a* of said pulley. On the contrary, the transfer rails extend across said pulley 3*a*, above the pulley if it is shifted downwards, or beneath it if it is shifted upwards.

To perform this half-turn 12, the transfer rails 11 may describe for example a circular arc, or any other suitable curved path.

The transfer rails 13 of the incoming area 4 and the transfer rails 13 of the outgoing area 5 leading to sidings may converge towards each other subsequently so as to lead to a single siding or to dispense with the intermediate pulleys 3*c*. On the other hand, each transfer rail 11 may advantageously consist of a pair of substantially parallel ramps having a constant gage and cooperating with matching rollers or small wheels of the vehicle carriers, in a manner known per se.

A system according to the present invention comprises preferably two embarking/disembarking stations disposed at each end of the vehicle circulation tracks. These stations are either identical or constructed according to two different forms of embodiment. However, an aerial ropeway transport system according to the present invention may comprise intermediate embarking/disembarking stations as described hereinabove. In this case, the circulation tracks may be diverted outwardly at right angles for installing the two pulleys 3 off-set longitudinally with respect to the local direction of the incoming tracks 4 and outgoing tracks 5, but at right angles to the general direction of travel of the vehicles between the end stations.

Various forms of embodiment consisting of a combination of characteristic features taken from each one of the specific forms of embodiment given herein by way of example may be contemplated by those conversant with the Art. Thus, for instance, each one of the component elements disclosed, notably each pulley 3, may be replaced by equivalent means. Moreover, the present invention is applicable generally to any aerial ropeway transport system comprising two carrying and haulage ropes other than the above-described system, given by way of example, for transporting travellers and goods.

I claim:

1. An aerial transport system comprising a pair of substantially parallel carrying and haulage ropes travelling continuously and forming two endless loops; at least two pair of end pulleys respectively engaged with said ropes to define said loops, at least one pulley in each pair being a driving pulley, said pulleys being disposed in embarking and disembarking stations, at least one vehicle having releasable grips for gripping said two ropes, means for engaging or disengaging said grips, and means for supporting and guiding the vehicles at the embarking and disembarking stations when said grips are disengaged from the ropes whereby the vehicle can be engaged between, driven and carried by, said ropes, the two end pulleys engaged by each rope respectively in at least one of said embarking and disembarking stations being offset longitudinally with respect to one another to form between them a free space of such dimension to permit the engagement and the disengagement of the vehicle between and from between said ropes in said free space.

2. The aerial transport system of claim 1, wherein in at least one embarking station at least one of said ropes cooperates with only one end pulley.

3. The aerial transport system according to either claim 1 or 2, wherein in at least one of said embarking and disembarking stations each rope cooperates with only one end pulley, with said pulleys being longitudinally offset.

4. The aerial transport system according to claim 2, including in at least one embarking and disembarking station at least two end pulleys cooperating with one of said ropes.

5. The aerial transport system of claim 2, wherein, in the engaged condition the clamping grips bear on the top of the ropes.

6. The aerial transport system of claim 1, wherein the vehicle includes a carrier having two pairs of clamping grips.

7. The aerial transport system of claim 1, wherein the distance between the two ropes is kept constant both upstream and downstream of the end pulleys.

8. The aerial transport system of claim 2, characterized in that it is free of rollers for diverting the ropes and changing their relative spacing upstream and downstream of the end pulleys of at least one embarking and disembarking station.

9. The aerial transport system of claim 2, characterized in that it is free of rollers for diverting the ropes between the end pulleys of at least one embarking and disembarking station.

10. The aerial transport system of claim 2, wherein the length of the free space formed between two longitudinally off-set end pulleys is greater than the length of the carrier of the vehicle.

11. The aerial transport system of claim 2, wherein, in at least one embarking and disembarking station, the end pulleys are disposed so that the outer and inner ropes of the incoming tracks are also the outer and inner ropes of the outgoing track, the relative positions of ropes with respect to each other between the two incoming and outgoing tracks remaining unchanged.

12. The aerial transport system of claim 2, wherein in at least one embarking and disembarking station, the ropes do not cross each other between the end pulleys.

13. The aerial transport system of claim 2, wherein in at least one embarking and disembarking station, said endless loops do not cross each other.

14. The aerial transport system of claim 2, wherein the end pulleys of at least one embarking and disembarking station have parallel axes.

15. The aerial transport system of claim 2, wherein in at least one embarking and disembarking station, the axes of the end pulleys therein are inclined with respect to each other.

16. The aerial transport system of claim 15 wherein the axes of said end pulleys are inclined to each other at right angles.

17. The aerial transport system of claim 2, wherein, in at least one embarking and disembarking station, the axes of said end pulleys are coplanar.

18. The aerial transport system of claim 17, wherein the plane containing the axes of pulleys also contains the longitudinal direction of said ropes.

19. The aerial transport system of claim 2, wherein at least one end pulley of an embarking and disembarking station lies in the plane P of the pair of ropes of the outgoing and incoming tracks.

20. The aerial transport system of claim 2, wherein the end pulleys of at least one embarking and disembarking station are coplanar.

21. The aerial transport system of claim 2, wherein the axis of at least one end pulley of at least one embarking and disembarking station is perpendicular to the plane P of said ropes.

22. The aerial transport system of claim 2, wherein the axis of at least one end pulley of at least one embarking and disembarking station is parallel to the plane P of said ropes.

23. The aerial transport system of claim 2, wherein the axis of at least one end pulley is set in a longitudinal direction.

24. The aerial transport system of claim 2, wherein the axis of at least one end pulley is set in a lateral direction.

25. The aerial transport system of claim 2, wherein the axis of at least one end pulley of at least one embarking and disembarking station is offset at right angles to the plane P of said ropes.

26. The aerial transport system of claim 1, comprising, in at least one of said embarking and disembarking stations, intermediate pulleys disposed upstream and downstream of at least one of said end pulleys and being offset at right angles to the plane P of said ropes so as to return at least one rope towards the end pulley or pulley corresponding to said one rope.

27. The aerial transport system of claim 25, wherein the longitudinally endmost pulley is offset downwards.

28. The aerial transport system of claim 2, wherein the end pulleys in at least one of said embarking and disembarking stations have different diameters and rotate at different speeds so that the ropes move in synchronism with each other.

29. The aerial transport system of claim 28, wherein the endmost pulley has a greater diameter, and rotates at a lower speed, than the other pulley.

30. The aerial transport system of claim 2, wherein in at least one of said embarking and disembarking stations, the outer rope of the incoming track cooperates with the longitudinally endmost pulley, the inner rope of the incoming track cooperating with a longitudinally less endmost pulley.

31. The aerial transport system of claim 2, wherein the means for supporting and guiding the carrier or vehicle do not intersect the longitudinally vertical plane containing the rope cooperating with the longitudinally less endmost pulley.

32. The aerial transport system of claim 31, wherein the means for supporting and guiding the carrier or vehicle do not intersect the longitudinal vertical plane containing the rope cooperating with the longitudinally endmost pulley upstream or downstream of said pulley.

33. The aerial transport system of claim 2, wherein said ropes have different lengths.

34. An aerial transport system comprising a pair of substantially parallel carrying and haulage ropes travelling continuously and forming two endless loops; at least two pairs of end pulleys respectively engaged with said ropes to define said loops, at least one pulley in each pair being a driving pulley, said end pulleys being disposed in embarking and disembarking stations, at least one vehicle having a carrier including releasable grips for gripping the two ropes, means for engaging or disengaging said grips and grip means for supporting and guiding the vehicles at the embarking and disembarking stations when said grips are released from said ropes, whereby along the route the vehicles are engaged between, driven and carried by said ropes; at least two end pulleys engaged by each rope respectively in at least one of said embarking and disembarking stations being offset longitudinally and forming between them a free space of such dimension as to permit the engagement and disengagement of the vehicle between and from between said ropes in said free space the length of the free space formed between two longitudinally offset end pulleys being greater than the length of a carrier, said means for supporting and guiding the vehicles extending in said free space at least transversely across the less endmost pulley to permit the coupling and uncoupling of the vehicles with respect to the ropes downstream and upstream of the end pulleys.

* * * * *